US008476191B2

(12) United States Patent
Hada et al.

(10) Patent No.: US 8,476,191 B2
(45) Date of Patent: Jul. 2, 2013

(54) HEAT-SENSITIVE RECORDING BODY AND METHOD FOR PRODUCING SAME

(75) Inventors: Toshiro Hada, Amagasaki (JP); Yoshihiko Yoneda, Amagasaki (JP)

(73) Assignee: Oji Holdings Corporation, Tokyo (JP)

( * ) Notice: Subject to any disclaimer, the term of this patent is extended or adjusted under 35 U.S.C. 154(b) by 281 days.

(21) Appl. No.: 13/121,815

(22) PCT Filed: Oct. 2, 2009

(86) PCT No.: PCT/JP2009/067239
§ 371 (c)(1),
(2), (4) Date: Mar. 30, 2011

(87) PCT Pub. No.: WO2010/038864
PCT Pub. Date: Apr. 8, 2010

(65) Prior Publication Data

US 2011/0177942 A1 Jul. 21, 2011

(30) Foreign Application Priority Data

Oct. 3, 2008 (JP) ..... 2008-258354

(51) Int. Cl.
*B41M 5/42* (2006.01)

(52) U.S. Cl.
USPC ..... 503/226; 427/152

(58) Field of Classification Search
None
See application file for complete search history.

(56) References Cited

U.S. PATENT DOCUMENTS

| | | | | |
|---|---|---|---|---|
| 6,017,848 | A | 1/2000 | Mando | |
| 7,049,269 | B2 | 5/2006 | Hara | |
| 2003/0157427 | A1 | 8/2003 | Hara | |
| 2007/0032381 | A1 | 2/2007 | Nagasaki et al. | 503/226 |
| 2007/0184978 | A1 | 8/2007 | Takano et al. | 503/226 |

FOREIGN PATENT DOCUMENTS

| | | | |
|---|---|---|---|
| CN | 101011897 | | 8/2007 |
| EP | 1 243 439 | | 9/2002 |
| EP | 1 900 542 | | 3/2008 |
| JP | 7-117354 | | 5/1995 |
| JP | 11-314458 | | 11/1999 |
| JP | 2001-270250 | | 10/2001 |
| JP | 2003-19864 | | 1/2003 |
| JP | 2003-94826 | A1 | 4/2003 |
| JP | 2008-62537 | A1 | 3/2008 |
| JP | 2008-194843 | A1 | 8/2008 |

OTHER PUBLICATIONS

International Search Report for International Application No. PCT/JP2009/067239 dated Nov. 25, 2009.
Extended European Search Report mailed Mar. 7, 2012 (3 pages).

*Primary Examiner* — Bruce H Hess
(74) *Attorney, Agent, or Firm* — Kratz, Quintos & Hanson, LLP

(57) ABSTRACT

The present invention relates to a heat-sensitive recording material comprising one or more heat-sensitive recording layers, an intermediate layer and a protective layer that are formed on one side of a transparent support, and the present inventions provide a heat-sensitive recording material and a process for providing the heat-sensitive recording material, wherein the one or more heat-sensitive recording layers are formed from one or more heat-sensitive recording layer coating compositions that each contain a leuco dye and a developer, the intermediate layer is formed from an intermediate layer coating composition that contains a hydrazine-based compound and an oxazoline group-containing compound, and the protective layer is formed from a protective layer coating composition that contains a modified polyvinyl alcohol.

11 Claims, No Drawings

HEAT-SENSITIVE RECORDING BODY AND METHOD FOR PRODUCING SAME

TECHNICAL FIELD

The present invention relates to a heat-sensitive recording material using a color reaction between a leuco dye and a developer.

BACKGROUND ART

Heat-sensitive recording materials using a color reaction between a leuco dye and a developer are well known. The heat-sensitive recording materials are relatively inexpensive, and the recording apparatuses are compact and easily maintained. Therefore, heat-sensitive recording materials are used not only as recording media for facsimiles, a variety of calculator, and the like, but also as recording media for the printers of medical image diagnosis apparatuses, recording media for CAD plotters, and the like.

Among the various heat-sensitive recording materials, those used as medical apparatus recording media used with schaukastens require high transparency and recording density. Therefore, in these heat-sensitive recording materials used as recording media of medical apparatus, the thermal energy of the thermal head increases, thereby more easily causing sticking or noise during the recording. To solve this problem, a general heat-sensitive recording layer has a protective layer thereon.

As one general technique for improving the water resistance of the protective layer, Patent Literature 1 discloses a heat-sensitive recording material that uses acetoacetyl-modified polyvinyl alcohol as the adhesive of the protective layer, and contains a hydrazine-based compound as a water-resistant agent in the heat-sensitive recording layer. Further, Patent Literature 2 suggests providing an intermediate layer containing a water-soluble resin as the main component on the heat-sensitive recording layer in order to prevent the heat-sensitive recording layer from mixing with the protective layer, thereby preventing a decrease in transparency. However, these prior arts could not guarantee satisfactory effects, particularly in terms of the desired transparency, water resistance and heat resistance required for image-recording media of medical image diagnosis apparatuses.

PRIOR ART DOCUMENTS

Patent Literature

[Patent Literature 1] Japanese Unexamined Patent Publication No. 1999-314458

[Patent Literature 2] Japanese Unexamined Patent Publication No. 2003-94826

SUMMARY OF INVENTION

Technical Problem

An object of the present invention is to provide a heat-sensitive recording material superior in transparency, water resistance, and heat resistance.

Technical Solution

The inventors of the present invention conducted extensive studies in view of the prior arts, and solved the above problems. Specifically, the present invention relates to the following heat-sensitive recording materials.

Item 1. A heat-sensitive recording material comprising one or more heat-sensitive recording layers, an intermediate layer and a protective layer that are formed on one side of a transparent support, wherein:

the one or more heat-sensitive recording layers are formed from one or more heat-sensitive recording layer coating compositions that each contain a leuco dye and a developer, the intermediate layer is formed from an intermediate layer coating composition that contains a hydrazine-based compound and an oxazoline group-containing compound, and the protective layer is formed from a protective layer coating composition that contains a modified polyvinyl alcohol.

Item 2. The heat-sensitive recording material according to Item 1, wherein the mass ratio of the hydrazine-based compound to the oxazoline group-containing compound ranges from 70:30 to 95:5.

Item 3. The heat-sensitive recording material according to Item 1 or 2, wherein the modified polyvinyl alcohol is an acetoacetyl-modified polyvinyl alcohol.

Item 4. The heat-sensitive recording material according to any one of Items 1 to 3, wherein the intermediate layer coating composition contains a water-dispersible adhesive that is a polymer latex having a heterogeneous particle structure that contains a urethane resin component in at least one phase.

Item 5. The heat-sensitive recording material according to Item 4, wherein the intermediate layer coating composition further contains a water-soluble adhesive, and the mass ratio of the water-dispersible adhesive to the water-soluble adhesive ranges from 90:10 to 50:50.

Item 6. The heat-sensitive recording material according to any one of Items 1 to 5, wherein the leuco dye has a form of composite particles containing a leuco dye and a hydrophobic resin.

Item 7. The heat-sensitive recording material according to any one of Items 1 to 6, wherein the one or more heat-sensitive recording layers, the intermediate layer and the protective layer are formed by simultaneously applying and drying the one or more heat-sensitive recording layer coating compositions, the intermediate layer coating composition, and the protective layer coating composition.

Item 8. The heat-sensitive recording material according to any one of Items 1 to 7, wherein the one or more heat-sensitive recording layers each contain a leuco dye and a developer, the intermediate layer contains a hydrazine-based compound and an oxazoline group-containing compound, and the protective layer contains a modified polyvinyl alcohol.

Item 9. The heat-sensitive recording material according to any one of Items 1 to 8, wherein the transparent support is a polyethylene terephthalate film.

Item 9A. The heat-sensitive recording material according to any one of Items 1 to 9, further comprising an anchor coat layer wherein the anchor coat layer is formed from an anchor coat layer coating composition containing a water-dispersible adhesive.

Item 10. A process for producing a heat-sensitive recording material comprising one or more heat-sensitive recording layers, an intermediate layer and a protective layer that are formed on one side of a transparent support, the process comprising the steps of:

(1) forming one or more heat-sensitive recording layers using one or more heat-sensitive recording layer coating compositions each containing a leuco dye and a developer;

(2) forming an intermediate layer using an intermediate layer coating composition containing a hydrazine-based compound and an oxazoline group-containing compound; and (3) forming a protective layer using a protective layer coating composition containing a modified polyvinyl alcohol.

Item 11. The process according to Item 10, wherein, in the steps (1), (2) and (3), the one or more heat-sensitive recording layers, the intermediate layer and the protective layer are formed by simultaneously applying and drying the one or more heat-sensitive recording layer coating compositions, the intermediate layer coating composition and the protective layer coating composition.

Item 11A. The process according to Items 10 or 11 for producing a heat-sensitive recording material further comprising an anchor coat layer, the process further comprising the step of forming an anchor coat layer from an anchor coat layer coating composition containing a water-dispersible adhesive.

Item 12. The process according to Item 10, wherein the step (1) of forming one or more heat-sensitive recording layers using one or more heat-sensitive recording layer coating compositions each containing a leuco dye and a developer is performed by forming a first heat-sensitive recording layer using a first heat-sensitive recording layer coating composition containing a leuco dye and a developer; and forming a second heat-sensitive recording layer using a second heat-sensitive recording layer coating composition containing a leuco dye and a developer.

This process can be otherwise described as a process for producing a heat-sensitive recording material comprising a first heat-sensitive recording layer, a second heat-sensitive recording layer, an intermediate layer and a protective layer that are formed on one side of a transparent support, the process comprising the steps of:

(1) forming a first heat-sensitive recording layer using a first heat-sensitive recording layer coating composition containing a leuco dye and a developer;

(1A) forming a second heat-sensitive recording layer using a second heat-sensitive recording layer coating composition containing a leuco dye and a developer;

(2) forming an intermediate layer using an intermediate layer coating composition containing a hydrazine-based compound and an oxazoline group-containing compound; and (3) forming a protective layer using a protective layer coating composition containing a modified polyvinyl alcohol.

Item 12A. The process according to Item 12 for producing a heat-sensitive recording material further comprising an anchor coat layer, the process further comprising the step of forming an anchor coat layer from an anchor coat layer coating composition containing a water-dispersible adhesive.

Item 12B. The process according to Item 12A, wherein the steps of forming the first heat-sensitive recording layer, the second heat-sensitive recording layer, the intermediate layer, the protective layer, and the anchor coat layer are performed by simultaneously applying and drying the first heat-sensitive recording layer coating composition and the anchor coat coating composition to form the first heat-sensitive recording layer and the anchor coat layer; and simultaneously applying and drying the second heat-sensitive recording layer coating composition, the intermediate layer coating composition and the protective layer coating composition to form the second heat-sensitive recording layer, the intermediate layer and the protective layer.

The present invention is more specifically described below.

Intermediate Layer

In the present invention, the intermediate layer is formed by using an intermediate layer coating composition containing a hydrazine-based compound and an oxazoline group-containing compound.

With this intermediate layer coating composition containing a hydrazine-based compound and an oxazoline group-containing compound, it is possible to obtain a heat-sensitive recording material superior in transparency, water resistance, and heat resistance.

In the intermediate layer coating composition, the mass ratio of the hydrazine-based compound to the oxazoline group-containing compound is preferably 70:30 to 95:5, more preferably 85:15 to 95:5. By specifying the mass ratio of the oxazoline group-containing compound to 5 or more, it is possible to further improve the water resistance and heat resistance, as well as improve the quality of the recording surface. By also specifying the mass ratio of the oxazoline group-containing compound to 30 or less, it is possible to improve the thermal-background-fogging resistance.

Examples of hydrazine-based compounds include hydrazines and monohydrates thereof, phenylhydrazine, methylhydrazine, ethylhydrazine, n-propylhydrazine, n-butylhydrazine, ethylene-1,2-dihydrazine, propylene-1,3-dihydrazine, butylene-1,4-dihydrazine, benzoic acid hydrazide, formic acid hydrazide, acetic acid hydrazide, propionic acid hydrazide, n-butyric acid hydrazide, isobutyric acid hydrazide, n-valeric acid hydrazide, isovaleric acid hydrazide, pivalic acid hydrazide, carbohydrazide, adipic acid dihydrazide, phthalic acid dihydrazide, isophthalic acid dihydrazide, terephthalic acid dihydrazide, oxalic acid dihydrazide, malonic acid dihydrazide, succinic acid dihydrazide, glutaric acid dihydrazide, sebacic acid dihydrazide, maleic acid dihydrazide, fumaric acid dihydrazide, itaconic acid dihydrazide, polyacrylic acid hydrazide, and the like. They may be used solely, or in a combination of two or more.

Among them, dicarboxylic acid dihydrazide such as adipic acid dihydrazide, phthalic acid dihydrazide, isophthalic acid dihydrazide, terephthalic acid dihydrazide, oxalic acid dihydrazide, malonic acid dihydrazide, succinic acid dihydrazide, glutaric acid dihydrazide, sebacic acid dihydrazide, maleic acid dihydrazide, fumaric acid dihydrazide, itaconic acid dihydrazide, and the like are particularly preferable. In terms of providing water resistance, water solubility, safety, etc., adipic acid dihydrazide is most preferable.

The total content of the hydrazine-based compound and the oxazoline group-containing compound in the intermediate layer coating composition is not particularly limited, and may be appropriately determined depending on the type of the modified polyvinyl alcohol used for the protective layer. The total content is preferably not less than 5 parts by mass and not more than 50 parts by mass, more preferably not less than 10 parts by mass and not more than 35 parts by mass, particularly preferably not less than 15 parts by mass and not more than 20 parts by mass, based on 100 parts by mass of the modified polyvinyl alcohol used for the protective layer. By specifying the total content within this range, it is possible to further improve the water resistance and heat resistance.

Examples of the oxazoline group-containing compounds include homopolymers of addition polymerizable oxazolines, copolymers of addition polymerizable oxazolines, and one or more of other monomers.

In the present invention, "addition polymerizable oxazoline" is those represented by the following General Formula (1).

[Chem. 1]

Formula (1)

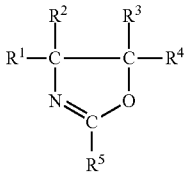

wherein $R^1$, $R^2$, $R^3$, $R^4$ each independently represent a hydrogen atom, halogen atoms, alkyl group, aralkyl group, phenyl group, or substituted phenyl group, and $R^5$ represents a non-cyclic organic group having an addition polymerizable unsaturated bond.

Examples of halogen atoms include a fluorine atom and a chlorine atom.

Examples of alkyl group include $C_{1-12}$ alkyl group, more preferably $C_{1-8}$ alkyl group.

Examples of alkoxy group include $C_{1-12}$ alkoxy group, more preferably $C_{1-8}$ alkoxy group.

Examples of aralkyl group include $C_{7-20}$ aralkyl group.

Examples of substituents of the substituted phenyl group include halogen atoms, alkyl group and alkoxy group. Examples of halogen atoms, alkyl group and alkoxy group are the same as above. The substituent may be a single substituent, or a plurality of substituents.

Examples of non-cyclic organic groups containing an addition polymerizable unsaturated bond include alkenyl group.

Examples of alkenyl group include straight-chain or branched-chain $C_{2-20}$, preferably $C_{2-15}$, more preferably $C_{2-10}$, further preferably $C_{2-6}$ alkenyl group; namely, ethenyl group, propenyl group, 1-butenyl group, pentenyl group, hexenyl group, heptenyl group, octenyl group, nonenyl group, decenyl group and the like.

Examples of addition polymerizable oxazoline include 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline, and 2-isopropenyl-5-ethyl-2-oxazoline. The mixture may be made from one or more of them. Among them, 2-isopropenyl-2-oxazoline is industrially suitable, as it is readily available.

In the case of using a copolymer of addition polymerizable oxazoline, and one or more of other monomers as the oxazoline group-containing compound, the proportion of addition polymerizable oxazoline is preferably not less than 5 mass % of the total amount of the copolymer. By specifying this proportion, it is possible to further improve water resistance. Examples of other monomers include any monomers copolymerizable with addition polymerizable oxazoline through the organic group having an addition polymerizable unsaturated bond; namely, (meth)acrylic esters, (meth)acrylic acid salts, unsaturated nitriles, unsaturated amides, vinyl ethers, α-olefins, halogen-containing α,β-unsaturated monomers, and α,β-unsaturated aromatic monomers.

Examples of (meth)acrylic esters include methyl (meth) acrylate, butyl (meth)acrylate, 2-ethylhexyl (meth)acrylate , and methoxy polyethylene glycol (meth)acrylate.

Examples of (meth)acrylic acid salts include sodium (meth)acrylate, potassium (meth)acrylate, and ammonium (meth) acrylate.

Examples of unsaturated nitriles include (meth) acrylonitrile.

Examples of unsaturated amides include (meth)acrylamide and N-methylol(meth)acrylamide.

Examples of vinyl esters include vinyl acetate and vinyl propionate. Examples of vinyl ethers include methyl vinyl ether and ethyl vinyl ether. Examples of α-olefins include ethylene and propylene. Examples of halogen-containing α,β-unsaturated monomers include vinyl chloride, vinylidene chloride and vinyl fluoride. Examples of α,β-unsaturated aromatic monomers include styrene and a-methyl styrene.

These monomers may be used solely, or in a combination of two or more.

The oxazoline group-containing compound can be produced by subjecting an addition polymerizable oxazoline to solution polymerization or emulsion polymerization in an aqueous medium using a known polymerization method. As required, the addition polymerizable oxazoline is mixed with one or more of other monomers before the polymerization.

The aqueous medium may be any medium that can be mixed with water, such as, for example, water, methanol, ethanol, propanol, isopropanol, butanol, tert-butanol, ethylene glycol, ethylene glycol monomethyl ether, ethylene glycol monobutyl ether, diethylene glycol, acetone, methyl ethyl ketone, etc.

The intermediate layer coating composition preferably further contains a water-dispersible adhesive.

The content of the water-dispersible adhesive in the intermediate layer coating composition is preferably about 45 to 85 mass %, more preferably about 60 to 80 mass %, based on the total solids content of the intermediate layer coating composition.

The type of water-dispersible adhesive is not particularly limited; however, latexes are preferable. Examples of latexes include vinyl acetate latex, urethane latex, acrylic latex, styrene-butadiene latex, and polymer latex having a heterogeneous particle structure. They may be used solely, or in a combination of two or more.

Among them, polymer latex having a heterogeneous particle structure is preferable.

The heterogeneous particle structure of the polymer latex having a heterogeneous particle structure is not particularly limited. The details of the structure and preparation method of the heterogeneous particle structure are described in "Gosei Latex no Oyo (Application of Synthetic Latex)" (Takaaki Sugimura, Yasuo Kataoka, Soichi Suzuki, Keiji Kasahara; Kobunshi Kankokai (1993)). Examples of heterogeneous particle structures include core-shell structure, composite structure, localized structure, potbellied structure, raspberry-like structure, multi-particle composite structure, crescent-like structure, IPN (interpenetrating polymer network) etc. In the present invention, a core-shell structure, composite structure, raspberry-like structure, and multi-particle composite structure are preferable. Among the polymer latexes, a polymer latex containing an urethane resin component at least one phase in a heterogeneous particle structure is particularly preferable.

The polymer latex containing an urethane resin component at least one phase in a heterogeneous particle structure may contain, apart from the urethane resin, natural rubber, polybutadiene, styrene-butadiene polymer, acrylonitrile-butadiene polymer, methylmethacrylate-butadiene polymer, polyacrylonitrile, polyvinyl acetate, polyethyl acrylate, polybutyl acrylate, poly methyl methacrylate, polyvinylchloride or the like.

Among them, a polymer latex containing styrene-butadiene polymer, acrylonitrile-butadiene polymer, and methylmethacrylate-butadiene polymer is preferable.

Particularly, a latex obtained by polymerizing a styrene monomer and butadiene monomer in an aqueous medium containing a polyurethane ionomer is more preferable.

The content of urethane resin in the polymer latex containing an urethane resin component at least one phase in a heterogeneous particle structure is preferably 3 to 90 mass %, more preferably 20 to 80 mass %.

The polymer latex containing an urethane resin component at least one phase in a heterogeneous particle structure is commercially available, and can be obtained easily.

Examples include PATELACOLE (registered trademark) H2090, H2020A etc. (product of Dainippon Ink & Chemicals, Inc.).

The intermediate layer coating composition preferably further contains a water-soluble adhesive.

The content of the water-soluble adhesive in the intermediate layer coating composition is preferably about 10 to 50 mass %, more preferably 10 to 30 mass %, based on the total solids content of the intermediate layer coating composition.

As the water-soluble adhesive, it is preferable to use partially or entirely saponified polyvinyl alcohol or the like, which is not reactable with the hydrazine-based compound and/or the oxazoline group-containing compound, in terms of high transparency, and superior barrier property.

In the case of using both water-dispersible adhesive and water-soluble adhesive, the mass ratio of the water-dispersible adhesive to the water-soluble adhesive is preferably about 90:10 to 50:50, more preferably 90:10 to 70:30. By specifying the mass ratio of the water-dispersible adhesive to 50% or greater, it is possible to further improve the water resistance. By specifying the mass ratio of the water-dispersible adhesive to 90% or less, it is possible to further improve the barrier property, thereby preventing the heat-sensitive recording layer from mixing with the protective layer. This improves the transparency and the quality of the recording surface.

In addition to the above, the intermediate layer coating composition may further contain, as necessary, various additives, such as surfactants, waxes, pigments, defoaming agents, fluorescent brighteners, dyes, and the like.

Examples of surfactants include sodium dioctyl sulfosuccinate; sodium dodecylbenzene sulfonate acid sodium; fatty acid metal salts such as lauryl alcohol sulfuric acid ester, sodium salt; and fluorine-containing surfactant.

Examples of waxes include polyethylene wax, carnauba wax, paraffin wax, and ester wax.

Examples of pigments include kaolin, clay, talc, calcium carbonate, calcined kaolin, titanium oxide, amorphous silica, and aluminum hydroxide.

The intermediate layer coating composition may further contain one or more other crosslinking agents such as glyoxal, formalin, glycine, glycidyl esters, glycidyl ethers, dimethylolurea, ketene dimer, dialdehyde starch, melamine resins, polyamide resins, polyamide-epichlorohydrin resins, ketone-aldehyde resins, borax, boric acid, zirconium ammonium carbonate, epoxy compounds, etc.

The intermediate layer coating composition is prepared by mixing a hydrazine-based compound, an oxazoline group-containing compound, a water-dispersible adhesive, a water-soluble adhesive, and, as required, additives, in water that serves as a medium.

The obtained intermediate layer coating composition is applied so that the application amount after drying becomes about 0.5 to 5 g/m$^2$, preferably about 1.5 to 4 g/m$^2$, followed by drying, thereby forming the intermediate layer. The application and drying may be performed together with application and drying of one or more of other layers.

Protective Layer

In the present invention, the protective layer is formed using a protective layer coating composition containing a modified polyvinyl alcohol.

The modified polyvinyl alcohol contained in the protective layer coating composition crosslinks with the hydrazine-based compound and the oxazoline group-containing compound contained in the intermediate layer coating composition, thereby improving the heat resistance of the intermediate layer. Further, the crosslinking also improves the strength of the coating film, and thereby increases the running performance in the recording. The crosslinking further improves the barrier property and thereby increases the chemical resistance.

Examples of modified polyvinyl alcohol include acetoacetyl-modified polyvinyl alcohol, diacetone-modified polyvinyl alcohol, carboxy-modified polyvinyl alcohol, and silicon-modified polyvinyl alcohol.

Among them, the acetoacetyl-modified polyvinyl alcohol is preferable, because the combination of the acetoacetyl-modified polyvinyl alcohol with the hydrazine-based compound and oxazoline group-containing compound contained in the intermediate layer coating composition further improves water resistance, and also improves heat resistance, thereby ensuring superior running performance in the recording.

The content of the modified polyvinyl alcohol is preferably about 30 to 70 mass %, more preferably about 35 to 60 mass %, based on the total solids content of the protective layer coating composition. By specifying the content within this range, it is possible to increase the water resistance and the heat resistance, thereby increasing the running performance in the recording. This also improves the barrier property, thereby preventing background fogging or color fading of the alcohol or plasticizer. This prevents the transfer of the hydrazine-based compound and the oxazoline group-containing compound remaining in the intermediate layer.

To improve the barrier property, the polymerization degree of the modified polyvinyl alcohol is preferably about 1000 to 3500, more preferably about 1500 to 3000.

Insofar as the desired effects of the present invention are not impaired, the protective layer coating composition may further contain one or more aqueous adhesives selected from the group consisting of conventional water-dispersible adhesives and water-soluble adhesives, other than the aforementioned modified polyvinyl alcohol.

The water-dispersible adhesive may be selected from the above substances applicable to the intermediate layer coating composition. Examples of the water-dispersible adhesives include styrene-butadiene latexes, acrylic latexes, and urethane latexes. Among them, it is possible to select only one latex, or two or more latexes.

The proportion of the modified polyvinyl alcohol to the water-dispersible adhesive is not particularly limited; however, the proportion of the water-dispersible adhesive is preferably 10 to 70 parts by mass, more preferably 20 to 60 parts by mass, based on 100 parts by mass of the modified polyvinyl alcohol.

Examples of the water-soluble adhesives include completely saponified or partially saponified polyvinyl alcohol, and derivatives thereof; starch, and derivatives thereof; casein; gelatin; cellulose derivatives such as carboxymethylcellulose, hydroxymethylcellulose, hydroxyethylcellulose, hydroxypropylcellulose, methylcellulose and ethylcellulose; polyvinyl pyrrolidone; alkali salts of acrylic acid polymer; alkali salts of ethylene-acrylic acid copolymers; alkali salts of styrene-acrylic acid copolymers; alkali salts of styrene-maleic anhydride copolymers; alkali salts of isobutylene-maleic anhydride copolymers; and acrylamide copolymers. They may be used solely, or in a combination of two or more.

The protective layer coating composition may further contain a pigment. Examples of pigments include kaolin, aluminum hydroxide, calcined kaolin, colloidal silica, calcium carbonate, zinc oxide, aluminum oxide, titanium dioxide, amorphous silica, barium sulfate, talc, acryl-styrene resin fillers, nylon resin fillers, and urea-formalin resin fillers. Among them, it is preferable to contain a calcined kaolin together with at least one kind of kaolin and aluminum hydroxide in view of preventing residue adhesion to the thermal head.

The content of calcined kaolin is preferably about 0.3 to 5 mass % based on the total solids content of the protective layer coating composition. Further, the total amount of pigment is preferably about 15 to 35 mass % based on the total solids content of the protective layer coating composition.

The protective layer coating composition may further contain various additives, including alkyl phosphate salts such as alkyl phosphate ester potassium salt, such as lubricants stearamide, zinc stearate, calcium stearate, and polyethylene wax; surfactants, such as dialkylsulfosuccinate salts, alkylsulfonate salts, alkylcarboxylate salts, alkylethylene oxides; and fluorine-containing surfactants.

However, in order to prevent the generation of agglomerates, it is preferable that the protective layer coating composition does not contain a crosslinking agent.

The protective layer coating composition is prepared, for example, by mixing a modified polyvinyl alcohol with other adhesives, pigments, additives etc., as required, using water as its medium.

The obtained protective layer coating composition is applied so that the application amount after drying becomes about 0.5 to 10 g/m$^2$, preferably about 0.5 to 5 g/m$^2$, followed by drying, thereby forming the protective layer. The application and drying may be performed together with application and drying of other one or more layers.

Heat-Sensitive Recording Layer

The heat-sensitive recording layer of the present invention is prepared by using a heat-sensitive recording layer coating composition that contains a leuco dye and a developer.

The heat-sensitive recording layer may comprise a single layer, or a plurality of layers.

In the case of a heat-sensitive recording layer comprising a plurality of layers, heat-sensitive recording layer coating compositions for forming the respective layers may have the same constitution, or different constitutions. In other words, the plurality of heat-sensitive recording layers may be formed from the same kind of heat-sensitive recording layer coating composition, or from two or more kinds of heat-sensitive recording layer coating compositions, so that each layer has a different constitution.

The leuco dye and the developer are not particularly limited, and any known leuco dyes and developers may be used.

Examples of leuco dyes include the following. They may be used solely, or in a combination of two or more.

Leuco dyes providing red color include 3-diethylamino-7-chlorofluoran, 3-(N-ethyl-N-p-tolylamino)-7-methylfluoran, 3-diethylamino-6-methyl-7-chlorofluoran, 3-(N-ethyl-N-isoamylamino)-7-phenoxyfluoran, 3-diethylamino-6,8-dimethylfluoran, 3-di(n-butyl)amino-6-methyl-7-bromofluoran, 3,3-bis(1-n-amyl-2-methylindol-3-yl)phthalide, and 3-di(n-butyl)amino-7-chlorofluoran.

Leuco dyes providing blue color include 3,3-bis(4-diethylamino-2-ethylphenyl)-4-azaphthalide, 3,3-bis(p-dimethylaminophenyl)-6-dimethylaminophthalide, 3-(4-diethylamino-2-methylphenyl)-3-(4-dimethylaminophenyl)-6-dimethylaminophthalide, 3-(4-diethylamino-2-ethoxyphenyl)-3-(1-ethyl -2-methylindol-3-yl)-4-azaphthalide, 3-diphenylamino-6-diphenylaminofluoran, 3-(2-methyl-1-n-octylindol-3-yl)-3-(4-dimethylamino -2-ethoxyphenyl)-4-azaphthalide, and 3-(2,2-bis(1-ethyl-2-methylindol-3-yl)vinyl)-3-(4-diethylaminophenyl)phthalide.

Leuco dyes providing green color include 3-(N-ethyl-N-p-tolylamino)-7-(N-phenyl-N-methylamino)fluoran, 3-(N-ethyl-N-n-hexylamino)-7-anilinofluoran, 3-diethylamino-7-dibenzylaminofluoran, and 3-diethylamino-7-(o-chloroanilino)fluoran.

Leuco dyes providing yellow color include 3,6-dimethoxyfluoran, 1-(4-n-dodecyloxy-3-methoxyphenyl)-2-(2-quinolyl)ethylene, and 1,3,3-trimethylindoline-2,2'-spiro-6'-nitro-8'-methoxybenzopyran.

Leuco dyes providing black color include 3-pyrrolidino-6-methyl-7-anilinofluoran, 3-diethylamino-7-(m-trifluoromethylanilino)fluoran, 3-(N-isoamyl-N-ethylamino)-7-(o-chloroanilino)fluoran, 3-(N-ethyl-p-toluidino)-6-methyl-7-anilinofluoran, 3-(N-ethyl-N-2-tetrahydrofurfurylamino)-6-methyl-7-anilinofluoran, 3-diethylamino-6-chloro-7-anilinofluoran, 3-di(n-butyl)amino-6-methyl-7-anilinofluoran, 3-di(n-amyl)amino-6-methyl-7-anilinofluoran, 3-(N-isoamyl-N-ethylamino)-6-methyl-7-anilinofluoran, 3-(N-n-hexyl-N-ethylamino)-6-methyl-7-anilinofluoran, 3-di(n-butyl)amino-7-(2-chloroanilino)fluoran, 3-diethylamino-6-methyl-7-anilinofluoran, 3-diethylamino-6-methyl-7-(3-toluidino)fluoran, 3-diethylamino-6-methyl-7-(2,6-dimethylanilino)fluoran, and 3-diethylamino-6-methyl-7-(2,4-dimethylanilino)fluoran.

The leuco dye may be included in the heat-sensitive recording layer in the form of solid fine particles, obtained by wet-pulverizing the leuco dye together with a protective colloidal agent such as polyvinyl alcohol or methylcellulose using a sand mill, or in the form of composite particles containing the leuco dye and a hydrophobic resin.

The form of the composite particles comprising the leuco dye and the hydrophobic resin in the present invention may be, for example:

(1) a form of microcapsulated particles in which at least one leuco dye is encapsulated in a wall-film of a hydrophobic resin;

(2) a form in which at least one leuco dye is contained in a base material formed of a hydrophobic resin such as a polyvalent isocyanate; or (3) a form in which the particle surfaces of at least one leuco dye are polymerized with a compound having a unsaturated carbon bond.

The composite particles (1) are produced, for example, according to a method described in Japanese Unexamined Patent Publication No. 1985-244594; the composite particles (2) are produced, for example, according to a method described in Japanese Unexamined Patent Publication No. 1997-263057; and the composite particles (3) are produced, for example, according to a method described in Japanese Unexamined Patent Publication No. 2000-158822.

Leuco dyes in the composite particles are highly isolated from outside, and have advantages including reduction of background fogging caused by heat and humidity, and reduction of color fading in the recorded image. The composite particles in the above forms (1) and (2) are preferable because they include a leuco dye dissolved in an isocyanate or an organic solvent; therefore, a highly transparent heat-sensitive recording layer can be obtained compared with the case in which leuco dye is used in the form of solid fine particles.

There is no particular restriction on the hydrophobic resins for forming composite particles. Examples thereof include urea resins, urethane resins, urea-urethane resins, styrene resins, acryl resins, etc. Among them, urea resins and urea-urethane resins are preferable because they impart excellent thermal-background-fogging resistance.

Composite particles including a leuco dye dispersed in a urea resin or urea-urethane resin are prepared by dissolving a leuco dye in a polyvalent isocyanate compound to produce an oily solution, and emulsifying and dispersing the oily solution in a hydrophilic protective colloid solution such as polyvinyl alcohol so as to produce droplets having an average particle diameter of about 0.5 to 3.0 μm, more preferably about 0.5 to 1.5 μm; and then accelerating a polymerization reaction of the polyvalent isocyanate compound.

The polyvalent isocyanate compound is a compound that forms polyurea or polyurea-polyurethane by reacting with water, and may be a single polyvalent isocyanate compound, or a composition of a polyvalent isocyanate compound and a polyol and/or a polyamine that reacts therewith, an adduct of a polyol and a polyvalent isocyanate compound, or multimers such as biuret or isocyanurate adducts of a polyvalent isocyanate compound. A leuco dye is dissolved in such a polyvalent isocyanate compound, and the resulting solution is emulsified and dispersed in an aqueous medium containing a protective colloid substance, such as a polyvinyl alcohol, and optionally further mixed with a reactive substance, such as polyamine. Then, the polyvalent isocyanate compound is polymerized by heating the resulting emulsified dispersion, thereby preparing composite particles containing a leuco dye and a hydrophobic resin.

Examples of polyvalent isocyanate compounds include p-phenylenediisocyanate, 2,6-tolylenediisocyanate, 2,4-tolylenediisocyanate, naphthalene-1,4-diisocyanate, dicyclohexylmethane-4,4'-diisocyanate, 1,3-bis(isocyanatomethyl) cyclohexane, 3,3'-dimethyldiphenylmethane-4,4'-diisocyanate, xylylene-1,4-diisocyanate, tetramethylxylylenediisocyanate, 4,4'-diphenylpropanediisocyanate, hexamethylenediisocyanate, butylene-1,2-diisocyanate, cyclohexylene-1,2-diisocyanate, cyclohexylene-1,4-diisocyanate, 4,4',4"-triphenylmethanetriisocyanate, toluene-2,4,6-triisocyanate, a trimethylolpropane adduct of hexamethylenediisocyanate, a trimethylolpropane adduct of 2,4-tolylenediisocyanate, and a trimethylolpropane adduct of xylylenediisocyanate.

Further, examples of polyol compounds include ethylene glycol, 1,3-propanediol, 1,4-butanediol, 1,7-heptanediol, 1,8-octanediol, propylene glycol, 1,3-dihydroxybutane, 2,2-dimethyl-1,3-propanediol, 2,5-hexanediol, 3-methyl-1,5-pentanediol, 1,4-cyclohexane dimethanol, dihydroxycyclohexane, diethylene glycol, phenylethylene glycol, pentaerythritol, 1,4-di(2-hydroxyethoxy)benzene, 1,3-di(2-hydroxyethoxy)benzene, p-xylylene glycol, m-xylylene glycol, 4,4'-isopropylidenediphenol, and 4,4'-dihydroxydiphenylsulfone.

Examples of polyamine compounds include ethylenediamine, trimethylenediamine, tetramethylenediamine, pentamethylenediamine, hexamethylenediamine, p-phenylenediamine, m-phenylenediamine, 2,5-dimethylpiperazine, triethylenetriamine, triethylenetetramine, and diethylaminopropylamine.

The polyvalent isocyanate compounds, adducts of polyvalent isocyanates and polyols, and polyol compounds are not limited to the compounds described above; and two or more of them may be used in combination, as necessary.

Moreover, as required, the composite particles may further contain an aromatic organic compound (sensitizer) having a melting point of about 40 to 150° C. for increasing the later-described recording sensitivity; UV absorbers such as 2-hydroxy-4-octyloxybenzophenone or 2-(2'-hydroxy-3'-tert-butyl-5'-methylphenyl)-5-chlorobenzotriazole for improving the light stability; and stability-improving agents such as a hindered phenol or a hindered amine for improving preservation property of the recorded image.

The content of the leuco dye is not particularly limited; however, the content is preferably about 5 to 30 mass % based on the total solids content of the heat-sensitive recording layer. Further, in the case of containing the leuco dye in the form of composite particles, the content of the leuco dye in the composite particles is preferably about 10 to 70 mass %, more preferably about 30 to 60 mass % based on the total solids content of the composite particles.

Examples of developers include phenol compounds such as 4,4'-isopropylidenediphenol; 4,4'-cyclohexylidenediphenol; 2,2-bis(4-hydroxyphenyl)-4-methylpentane; 2,4'-dihydroxydiphenylsulfone; 4,4'-dihydroxydiphenylsulfone; 4-hydroxy-4'-isopropoxydiphenylsulfone; 3,3'-diallyl-4,4'-dihydroxydiphenylsulfone; 4-hydroxy-4'-allyloxydiphenylsulfone; 4-hydroxy-4'-methyldiphenylsulfone; butyl bis(p-hydroxyphenyl)acetate, methyl bis(p-hydroxyphenyl) acetate; 1,1-bis(4-hydroxyphenyl)-1-phenylethane; 1,4-bis [α-methyl-α-(4'-hydroxyphenyl)ethyl]benzene; 2-[(4-hydroxyphenyl)methyl]-6-[(2-hydroxyphenyl)methyl]-4-(sec-butyl)phenol or 2,6-bis[(4-hydroxyphenyl)methyl]-4-(sec-butyl)phenol; compounds having sulfonyl group(s) and/or ureido group(s) in their molecules, such as N-p-tolylsulfonyl-N'-phenylurea, 4,4'-bis[(4-methyl-3-phenoxycarbonylaminophenyl)ureido]diphenylsulfone, 4,4'-bis(n-p-tolylsulfonylamino carbonylamino) diphenylmethane, or N-p-tolylsulfonyl-N'-p-butoxyphenylurea; and zinc-salt compounds of aromatic carboxylic acid, such as zinc 4-[2-(p-methoxyphenoxy)ethyloxy]salicylate, zinc 4-[3-(p-tolylsulfonyl)propyloxy]salicylate, or 5-[p-(2-p-methoxyphenoxyethoxy)cumyl]salicylate. They may be used solely, or in a combination of two or more.

The content of developer is not particularly limited, and is determined depending on the types of the leuco dye and developer used. Preferably, the content is about 1 to 6 parts by mass per part by mass of leuco dye.

The heat-sensitive recording layer coating composition may contain a stability-improving agent to enhance the stability of recorded images. Examples of such stability-improving agents include hindered-phenol compounds such as 1,1,3-tris(2-methyl-4-hydroxy-5-cyclohexylphenyl)butane; 1,1,3-tris(2-methyl-4-hydroxy-5-tert-butylphenyl)butane, 2,2'-ethylidene bis(4,6-di-tert-butylphenol), 1,3-bis[a-methyl-a-(4'-hydroxyphenyl)ethyl]benzene, 4,4'-thiobis(2-methyl-6-tert-butylphenol), or 1,3,5-tris-(4-tert-butyl-3-hydroxy-2,6-dimethylbenzyl)isocyanuric acid; diphenylsulfone-containing epoxy compounds such as 4-(2-methyl-1,2-epoxyethyl)diphenylsulfone, 4-(2-ethyl-1,2-epoxyethyl) diphenylsulfone, or 4-benzyloxy-4'-(2-methyl-glycidyloxy) diphenylsulfone; and UV absorbers such as 2-(2'-hydroxy-5'-methylphenyl)benzotriazole, 2-hydroxy-4-benzyloxybenzophenone, or 2-hydroxy-4-octyloxybenzophenone.

As required, the heat-sensitive recording layer coating composition may contain a sensitizer to increase recording sensitivity. Examples of sensitizers include stearamide, 1,2-di(3-methylphenoxy)ethane,1,2-diphenoxyethane, parabenzylbiphenyl, naphthyl benzyl ether, benzyl-4-methylthiophenyl ether, 1-hydroxy-2-naphthoic acid phenyl ester, phenyl-1-hydroxynaphthoate, dibenzyl oxalate, di-p-methylbenzyl oxalate, di-p-chlorobenzyl oxalate, dibutyl terephthalate, dibenzyl terephthalate, and dibutyl isophthalate.

The heat-sensitive recording layer coating composition may contain at least one aqueous adhesive selected from the group consisting of water-soluble adhesives and water-dispersible adhesives.

Examples of the water-soluble adhesive include completely saponified or partially saponified polyvinyl alcohol, and derivatives thereof; starch, and derivatives thereof; casein; gelatin; cellulose derivatives such as carboxymethylcellulose, hydroxymethylcellulose, hydroxyethylcellulose, hydroxypropylcellulose, methylcellulose and ethylcellulose; polyvinyl pyrrolidone; alkali salts of acrylic acid polymer; alkali salts of ethylene-acrylic acid copolymers; alkali salts of styrene-acrylic acid copolymers; alkali salts of styrene-maleic anhydride copolymers; alkali salts of isobutylene-maleic anhydride copolymers; and acrylamide copolymers. They may be used solely, or in a combination of two or more.

The water-dispersible adhesive may be selected from the above substances applicable to the intermediate layer coating composition. Examples of the water-dispersible adhesive include vinyl acetate latex, urethane latex, acrylic latex, styrene-butadiene latex, and polymer latex having a heterogeneous particle structure.

In the present invention, in view of improving the adherence between the transparent support and the heat-sensitive recording layer, it is preferable to use, as a water-dispersible adhesive, a polymer latex having a heterogeneous particle structure containing a urethane resin component at least one phase. Insofar as the desired effects of the present invention are not impaired, other water-dispersible adhesives may be added.

To improve adherence and recording density, the content of the water-dispersible adhesive is preferably about 5 to 40 mass %, based on the total solids content of the heat-sensitive recording layer coating composition.

In particular, when at least one heat-sensitive recording layer is formed using a type of heat-sensitive recording layer coating composition, the content of water-dispersible adhesive is preferably 10 to 40 mass %, more preferably 15 to 40 mass %, based on the total solids content of the heat-sensitive recording layer coating composition.

Further, for example, when two or more heat-sensitive recording layers are formed between the anchor coat layer and the intermediate layer using at least two heat-sensitive recording layer coating compositions, the content of the water-dispersible adhesive in the first heat-sensitive recording layer coating composition for forming the first heat-sensitive recording layer adjacent to the anchor coat layer is preferably about 5 to 25 mass %, particularly preferably about 5 to 20 mass %, based on the total solids content of the first heat-sensitive recording layer coating composition. By specifying the content, it is possible to improve the adherence between the anchor coat layer and the heat-sensitive recording layer, further increase the recording density, and ensure excellent tone reproducibility.

Further, the content of the water-dispersible adhesive in the second heat-sensitive recording layer coating composition for forming the second heat-sensitive recording layer adjacent to the intermediate layer is preferably about 10 to 40 mass %, particularly preferably about 15 to 35 mass %, based on the total solids content of the second heat-sensitive recording layer coating composition. By specifying the content, it is possible to improve the adherence between the intermediate layer and the heat-sensitive recording layer, further increase the recording density, and ensure excellent tone reproducibility.

The total content of at least one aqueous adhesives selected from the group consisting of water-soluble adhesives and water-dispersible adhesives in the heat-sensitive recording layer coating composition is not particularly limited; however, the content is preferably 10 to 55 mass %, more preferably 15 to 50 mass %, further preferably about 20 to 45 mass %, based on the total solids content of each kind of heat-sensitive recording layer coating composition.

In addition to the above, the heat-sensitive recording layer coating composition may further contain other various known additives, such as surfactants, waxes, pigments, waterproofing agents, defoaming agents, fluorescent brighteners, dyes, and the like.

Examples of surfactants include fatty acid metal salts such as sodium dioctylsulfosuccinate, sodium dodecylbenzene sulphonate, or lauryl alcohol sulfate ester sodium salt; and fluorine-containing surfactants.

Examples of waxes include polyethylene wax, carnauba wax, paraffin wax, and ester wax.

Examples of pigments include kaolin, clay, talc, calcium carbonate, calcined kaolin, titanium oxide, amorphous silica, and aluminum hydroxide.

Examples of waterproofing agents include glyoxal, formalin, glycine, glycidyl esters, glycidyl ethers, dimethylolurea, ketene dimer, dialdehyde starch, melamine resins, polyamide resins, polyamide-epichlorohydrin resins, ketone-aldehyde resins, borax, boric acid, zirconium ammonium carbonate, epoxy compounds, hydrazine-based compounds, and oxazoline group-containing compounds.

The heat-sensitive recording layer coating composition is prepared, for example, by mixing a dispersion of leuco dye and a dispersion of a developer with an adhesive; together with, as required, additive(s), using water as its dispersion medium.

The dispersion of leuco dye can be prepared, for example, by forming composite particles containing leuco dye and a hydrophobic resin. The average particle diameter of the composite particles, as a volume average particle diameter measured with a laser diffraction particle size distribution analyzer, is about 0.5 to 3.0 μm, preferably about 0.5 to 1.5 μm. It is also possible to form solid fine particles by pulverizing leuco dye and a protective colloid substance such as polyvinyl alcohol or methylcellulose using a sand mill so that the volume average particle diameter measured with a laser diffraction particle size distribution analyzer becomes about 0.1 to 3.0 μm, preferably about 0.1 to 1.0 μm.

Further, a dispersion of developer can be prepared, for example, by pulverizing a developer and a protective colloid substance such as polyvinyl alcohol or methylcellulose using a sand mill so that the volume average particle diameter measured with a dynamic light-scattering particle size distribution analyzer becomes about 0.1 to 3.0 μm, preferably about 0.1 to 1.0 μm.

The obtained heat-sensitive recording layer coating composition is applied onto a transparent support or on other layers formed as required, such as an anchor layer, and dried to obtain a heat-sensitive recording layer. The application amount of the heat-sensitive recording layer coating composition is adjusted depending on the structure of the heat-sensitive recording material, recording density, or tone reproducibility etc. Generally, the amount is determined so that the application amount after drying becomes about 3 to 30 g/m$^2$.

For example, when only one heat-sensitive recording layer is provided, the heat-sensitive recording layer coating composition is applied onto a transparent support so that the application amount after drying becomes about 3 to 30 g/m$^2$, preferably about 15 to 25 g/m$^2$.

For example, when an anchor coat layer is provided on the transparent support, the first heat-sensitive recording layer is formed on the anchor coat layer, and the second heat-sensitive recording layer is formed on the first heat-sensitive recording layer, the first heat-sensitive recording layer coating composition is applied so that the application amount after drying becomes about 5 to 25 g/m$^2$, preferably about 10 to 20 g/m$^2$. Further, the second heat-sensitive recording layer coating composition is applied so that the application amount after drying becomes about 3 to 20 g/m$^2$, preferably about 3 to 15 g/m$^2$.

Transparent Support

The usable transparent support is not limited. Examples of transparent supports include biaxially stretched polyethylene terephthalate films (PET films), polypropylene films, polystyrene films, and vinyl chloride films having a thickness of about 30 to 300 μm.

The transparent support may be colored or colorless. In the case of using a colorless transparent support, at least one of the heat-sensitive recording layer, intermediate layer and protective layer, or a backside layer (described later) may be colored.

When used with schaukastens, a blue-colored PET film having a thickness of 100 to 200 μm, more preferably 150 to 200 μm, and a haze value of not more than 10%, more preferably not more than 5%, is preferable.

More specifically, this film has an appropriate thickness to increase the rigidity, thereby improving handling. Therefore, the sheet-type heat-sensitive recording material can be more easily attached and detached to/from a schaukasten. Further, the blue color suppresses glare when the user directly sees the film, thereby improving visibility. Furthermore, the lower haze value allows the film to more effectively transmit the light, thereby improving image uniformity and tone reproducibility from a low density to a high density.

Optionally, the transparent support may be subjected to a corona discharge treatment or conduction treatment using a conducting agent.

Heat-Sensitive Recording Material

As described above, the heat-sensitive recording material of the present invention is produced by separately preparing the heat-sensitive recording layer coating composition(s), the intermediate layer coating composition and the protective layer coating composition; and forming one or more heat-sensitive recording layers, an intermediate layer and a protective layer on one side of the transparent support using the heat-sensitive recording layer coating composition(s), the intermediate layer coating composition and the protective layer coating composition.

By separately preparing the intermediate layer coating composition containing the hydrazine-based compound, the oxazoline group-containing compound serving as crosslinking agents, and the coating composition containing a modified polyvinyl alcohol, it is possible to extend the pot life of the coating composition, and eliminate the generation of agglomerates, thereby reducing the application defects caused by agglomerates. This improves image quality.

In the heat-sensitive recording material, the one or more heat-sensitive recording layers, the intermediate layer, and the protective layer are formed in this order on the surface of the transparent support. Therefore, the protective layer and the intermediate layer are adjacent to each other.

After the intermediate layer and the protective layer are formed, the hydrazine-based compound and the oxazoline group-containing compound contained in the intermediate layer coating composition and the modified polyvinyl alcohol contained in the protective layer coating composition presumably undergo a crosslinking reaction at the interface between the two layers. However, a part of the compounds may remain unreacted. More specifically, the heat-sensitive recording material of the present invention includes a heat-sensitive recording material in which the intermediate layer contains the hydrazine-based compound and the oxazoline group-containing compound; and the protective layer contains the modified polyvinyl alcohol, even after the heat-sensitive recording material is completed. The heat-sensitive recording material of the present invention further includes a heat-sensitive recording material in which the heat-sensitive recording layer contains a leuco dye and a developer, the intermediate layer contains the hydrazine-based compound and the oxazoline group-containing compound, and the protective layer contains the modified polyvinyl alcohol.

Further, in the present invention, an anchor coat layer may be provided between the surface of the transparent support and one or more of the heat-sensitive recording layers, in order to increase the adherence between the heat-sensitive recording layer and the support. Providing the anchor coat layer also improves the recording density.

The anchor coat layer may be formed using an anchor coat layer coating composition that contains a water-dispersible adhesive as a main component.

The water-dispersible adhesive is not particularly limited, and may be appropriately selected from the aforementioned adhesives useful for the intermediate layer coating composition. Examples of water-dispersible adhesives include one or more of the group consisting of vinyl acetate latexes, urethane latexes, acrylic latexes, styrene-butadiene latexes, and polymer latexes having a heterogeneous particle structure.

Examples of polymer latexes having a heterogeneous particle structure include a polymer latex having a heterogeneous particle structure containing a urethane resin component in at least one phase.

In particular, in order to improve the adherence and water resistance to the transparent support, the anchor coat layer coating composition preferably contains, as a water-dispersible adhesive, a polymer latex having a heterogeneous particle structure containing a urethane resin component in at least one phase.

The content of the water-dispersible adhesive preferably ranges from 75 to 95 mass % based on the total solids content of the anchor coat layer coating composition. By specifying the content equal to or greater than 75 mass %, it is possible to further improve the adherence. By specifying the content equal to or less than 95 mass %, it is possible to provide application adequacy.

The anchor coat layer coating composition may also contain a water-soluble adhesive, insofar as the effects of the present invention are not impaired.

Examples of the water-soluble adhesives include polyvinyl alcohol compounds such as completely saponified or partially saponified polyvinyl alcohol and derivatives thereof; starch and derivatives thereof; casein; gelatin; cellulose derivatives such as carboxymethylcellulose, hydroxymethylcellulose, hydroxyethylcellulose, hydroxypropylcellulose, methylcellulose and ethylcellulose; polyvinyl pyrrolidone; alkali salts of acrylic acid polymer; alkali salts of ethylene-acrylic acid copolymers; alkali salts of styrene-acrylic acid copolymers; alkali salts of styrene-maleic anhydride copolymers; alkali salts of isobutylene-maleic anhydride copolymers; and acrylamide copolymers. They may be used solely, or in a combination of two or more.

The anchor coat layer coating composition may further contain various adjuvants, such as surfactants, waxes, pigments, crosslinking agents, defoaming agents, fluorescent dyes, coloring dyes, and the like, as required.

Examples of surfactants include fatty acid metal salts such as sodium dioctylsulfosuccinate, sodium dodecylbenzene sulphonate, or lauryl alcohol sulfate ester sodium salt; and fluorine-containing surfactants such as adducts of perfluoroalkyl ethylene oxide.

Examples of waxes include polyethylene wax, carnauba wax, paraffin wax, and ester wax.

Examples of pigments include kaolin, clay, talc, calcium carbonate, calcined kaolin, titanium oxide, amorphous silica, and aluminum hydroxide.

Examples of crosslinking agents include glyoxal, formalin, glycine, glycidyl esters, glycidyl ethers, dimethylolurea, ketene dimer, dialdehyde starch, melamine resins, polyamide resins, polyamide-epichlorohydrin resins, ketone-aldehyde resins, borax, boric acid, zirconium ammonium carbonate, epoxy compounds, hydrazine-based compounds, and oxazoline group-containing compounds.

The anchor coat layer coating composition is prepared by mixing a water-dispersible adhesive; for example, the polymer latex having a heterogeneous particle structure, a water-soluble adhesive, and as required, adjuvants, using water as its medium. The obtained anchor coat layer coating composition is applied onto a transparent support so that the application amount after drying becomes about 0.5 to 5 $g/m^2$, thereby forming the anchor coat layer. The application and drying may be performed together with application and drying of other one or more layers.

The heat-sensitive recording layer coating composition, the intermediate layer coating composition, the protective layer coating composition, and the anchor coat layer are applied by way of die coating, air knife coating, rod blade coating, bar coating, vali-bar coating, pure blade coating, short dwell coating, slot coating, extrusion coating, curtain coating, slide coating etc.

The layers may be formed by individually performing application and drying for each layer, or performing application of two more layers using the same coating composition. Further, it is possible to perform simultaneous multiple applications, in which applications of two or more layers are performed at the same time.

Examples of the methods for simultaneous multiple application include various bead applications and curtain applications in the slot coating, extrusion coating, slide coating, and curtain coating. Among them, it is preferable to perform simultaneous multiple applications by way of slide coating. The "simultaneous multiple applications" denotes a method of applying the upper and lower layers of the plurality of layers at the same time, in which the upper layer is applied before drying the lower layer.

In the present invention, it is preferable to form at least one heat-sensitive recording layer, an intermediate layer, and a protective layer by simultaneously applying and drying the heat-sensitive recording layer coating composition, the intermediate layer coating composition, and the protective layer coating composition.

For example, when forming only one heat-sensitive recording layer, it is preferable to form a heat-sensitive recording layer, an intermediate layer, and a protective layer by simultaneously applying and drying the heat-sensitive recording layer coating composition, the intermediate layer coating composition, and the protective layer coating composition.

When also forming an anchor coat layer, two or more adjacent layers may be formed at once by simultaneously applying and drying two or more coating compositions selected from the anchor coat layer coating composition, one or more heat-sensitive recording layer coating compositions, the intermediate layer coating composition, and the protective layer coating composition.

Further, when the heat-sensitive recording material has an anchor coat layer, two or more heat-sensitive recording layers, the intermediate layer and the protective layer, it is possible to simultaneously apply and dry the anchor coat layer coating composition, one or more heat-sensitive recording layer coating compositions, the intermediate layer coating composition and the protective layer coating composition, thereby forming an anchor coat layer, two or more heat-sensitive recording layers, an intermediate layer and a protective layer.

Furthermore, when the heat-sensitive recording material has an anchor coat layer, the first heat-sensitive recording layer, the second heat-sensitive recording layer, an intermediate layer, and a protective layer, which are layered in this order, it is possible to simultaneously apply and dry the anchor coat layer coating composition and the first heat-sensitive recording layer coating composition to form an anchor coat layer and the first heat-sensitive recording layer, and then simultaneously apply and dry the second heat-sensitive recording layer coating composition, the intermediate layer coating composition, and the protective layer coating composition to form the second heat-sensitive recording layer, an intermediate layer and a protective layer.

Such simultaneous application of multiple layers increases the wet application amount, and eases leveling of the coating composition. This is conducive to reduce application defects, thereby further improving image quality.

In the heat-sensitive recording material, a backside layer may be formed on the rear surface of the support using a backside layer coating composition containing a pigment such as resin particles, and an adhesive in order to improve the running performance of the heat-sensitive recording material during the recording.

Moreover, the heat-sensitive recording material may have various other arrangements, such as forming the heat-sensitive recording layer, or irradiating the protective layer with ultraviolet light or an electron beam to form a cured glossy layer.

After all of the layers are formed, or in any steps performed after all of the layers are formed, the surface may be treated with a supercalender to impart smoothness.

In addition, various known techniques employed in the field of heat-sensitive recording material manufacturing may be applied to the heat-sensitive recording material of the present invention, as required.

The resulting heat-sensitive recording material of the present invention thus produced has excellent transparency, water resistance and heat resistance, as well as superior surface quality of the recording surface and reduced thermal-background-fogging.

Effect of the Invention

The heat-sensitive recording material of the present invention has excellent transparency, water resistance and heat resistance, as well as superior surface quality of the recording surface and reduced thermal-background-fogging.

MODE FOR CARRYING OUT THE INVENTION

The present invention is more specifically explained below in reference to Examples. The present invention is, however, not limited to these examples.

In the explanation below, "part" means "part by mass" and "%" means "mass %", unless otherwise specified.

The volume average particle diameter of the composite particles and the pigment used in the Examples and Comparative Examples are measured using a SALD 2200 laser diffraction particle size distribution analyzer (product of Shimadzu Seisakusho Co.). The volume average particle diameter of the developer is measured using an LB-500 dynamic light-scattering particle size distribution analyzer (product of HORIBA, Ltd.).

EXAMPLE 1

Preparation of Liquid A (Composite Particle Dispersion)

Eleven parts of 3-diethylamino-6-methyl-7-(3-toluidino) fluoran, 6 parts of 3-diethylamino-6,8-dimethylfluoran and 5 parts of 3,3-bis(4-diethylamino-2-ethoxyphenyl)-4-azaphthalide, as a leuco dye, and 10 parts of 2-hydroxy-4-octyloxybenzophenone were dissolved in a mixed solvent composed of 2 parts of dicyclohexylmethane-4,4'-diisocyanate (product of Sumitomo Bayer Urethane Co., Ltd.: Desmodur W (registered trademark)) and 12 parts of m-tetramethylxylylenediisocyanate (TMXDI (registered trademark), product of Nihon Cytec Industries Inc.) while heating (150° C.). The resulting solution was gradually added to 100 parts of a 10% aqueous solution including 8.5 parts of partially saponified polyvinyl alcohol (PVA-217EE, product of Kuraray Co., Ltd.) and 1.5 part of the ethylene oxide adduct of an acetylene glycol (Olfine (registered trademark) E1010, product of Nissin Chemical Industry Co., Ltd.) as a surfactant. The mixture obtained was then emulsified and dispersed by agitation using a homogenizer at a speed of 10000 rpm. To the emulsified dispersion were added 30 parts of water and an aqueous solution obtained by dissolving 2.5 parts of a polyvalent amine compound (Epicure T, product of Shell International Petroleum Co.) in 22.5 parts of water. The resulting emulsified dispersion was homogenized, and then heated to 75° C. to carry out a polymerization reaction for 7 hours to prepare a dispersion of leuco dye-containing composite particles having an average particle diameter of 0.8 μm. The resulting dispersion was diluted with water to obtain a 25% leuco dye-containing composite particle dispersion. The resulting dispersion was called Liquid A.

Preparation of Liquid B (Developer Dispersion)

A composition containing 40 parts of 4,4'-cyclohexylidene diphenol, 55 parts of a 15% aqueous solution of partially saponified polyvinyl alcohol having a polymerization degree of 300 (PVA-203, product of Kuraray Co., Ltd.), and 60 parts of water was pulverized using an ultravisco mill until the average particle diameter became 0.25 μm, thus giving a developer dispersion. The resulting dispersion was called Liquid B.

Preparation of Heat-Sensitive Recording Layer Coating Composition

A heat-sensitive recording layer coating composition was prepared by mixing a composition comprising 100 parts of Liquid A, 140 parts of Liquid B, 75 parts of a latex (PATELACOLE (registered trademark) H2020A, solids content: 41%, product of Dainippon Ink & Chemicals, Inc.) in which styrene monomers and butadiene monomers are polymerized in an aqueous medium containing a polyurethane ionomer, 1.6 parts of a 5% aqueous solution of fluorine-containing surfactant (Megafac (registered trademark) F-444 (registered trademark), product of Dainippon Ink & Chemicals, Inc.), and 60 parts of water. The resulting dispersion was called Liquid J.

Preparation of Intermediate Layer Coating Composition

An intermediate layer coating composition was prepared by mixing a composition comprising 200 parts of a resin latex (PATELACOLE (registered trademark) H2020A, solids content: 41%, product of Dainippon Ink & Chemicals, Inc.) in which styrene monomers and butadiene monomers are polymerized in an aqueous medium containing a polyurethane ionomer, 200 parts of a 10% aqueous solution of partially saponified polyvinyl alcohol (PVA-217EE, product of Kuraray Co., Ltd.), 17.1 parts of a 35% dispersion of adipic acid dihydrazide (ADH-35, product of Otsuka Chemical Co., Ltd.), 8.0 parts of an oxazoline group-containing compound (Epocros (registered trademark) WS700, solids content: 25%, product of Nippon Shokubai Co., Ltd.), 4.6 parts of a 5% aqueous solution of fluorine-containing surfactant (Megafac F-444 (registered trademark), product of Dainippon Ink & Chemicals, Inc.), and 139.5 parts of water. The resulting dispersion was called Liquid M.

Preparation of Protective Layer Coating Composition

A protective layer coating composition was prepared by mixing a composition comprising 100 parts of an ionomeric urethane resin latex (Hydran (registered trademark) AP-30F, solids content: 20%, product of Dainippon Ink & Chemicals, Inc.), 500 parts of a 8% aqueous solution of acetoacetyl-modified polyvinyl alcohol (GOSEFIMER (registered trademark) Z-410, polymerization degree: about 2300, saponification degree: about 98% mole%, product of Nippon Synthetic Chemical Industry Co., Ltd.), 50 parts of a 60% slurry of kaolin (UW-90, product of Engelhard Corp.) with an average particle size of 1.6 μm, 3 parts of a 40% slurry of calcined kaolin having an average particle diameter of 2.5 μm (Ansilex 93 (registered trademark), product of Engelhard Corporation), 20 parts of stearamide (Hymicron L-271, solids content: 25%, product of Chukyo Yushi Co., Ltd.), 10 parts of polyethylene wax (SN coat 287, solids concentration: 40%, product of SAN NOPCO LIMITED), 3 parts of potassium stearyl phosphate (Upol (registered trademark) 1800, solids concentration: 35%, product of Matsumoto Yushi Seiyaku Kabushiki Kaisha), 1.2 parts of a 10% aqueous solution of fluorine-containing surfactant (Surflon (registered trademark) S-145, product of Seimi Chemical, Co., Ltd.) and 365 parts of water. The resulting dispersion was called Liquid P.

Preparation of Heat-Sensitive Recording Material

The heat-sensitive recording layer coating composition (Liquid J), the intermediate layer coating composition (Liquid M) and the protective layer coating composition (Liquid P) were applied in this order to one surface of a blue transparent polyethylene terephthalate film (product of Teijin DuPont Films Japan Limited: Melinex (registered trademark) 912, thickness: 175 μm, haze value: 1%) serving as a support in an amount of 20 g/m$^2$, 2.0 g/m$^2$, and 1.5 g/m$^2$, respectively, on a dry basis using a slide coater. The applications of the three layers were performed at the same time, followed by drying to obtain a heat-sensitive recording material.

EXAMPLE 2

The same heat-sensitive recording material as in Example 1 was obtained, except that the intermediate layer coating composition (Liquid M) was prepared using 20.6 parts of 35% adipic acid dihydrazide dispersion instead of 17.1 parts of 35% adipic acid dihydrazide dispersion, and 3.2 parts of oxazoline group-containing compound instead of 8.0 parts of oxazoline group-containing compound.

EXAMPLE 3

The same heat-sensitive recording material as in Example 1 was obtained, except that the intermediate layer coating composition (Liquid M) was prepared using 13.7 parts of 35% adipic acid dihydrazide dispersion instead of 17.1 parts of 35% adipic acid dihydrazide dispersion, and 12.8 parts of oxazoline group-containing compound instead of 8.0 parts of oxazoline group-containing compound.

EXAMPLE 4

The same heat-sensitive recording material as in Example 1 was obtained, except that the intermediate layer coating composition (Liquid M) was prepared using 22.2 parts of 35% adipic acid dihydrazide dispersion instead of 17.1 parts of 35% adipic acid dihydrazide dispersion, and 1.0 parts of oxazoline group-containing compound instead of 8.0 parts of oxazoline group-containing compound.

EXAMPLE 5

The same heat-sensitive recording material as in Example 1 was obtained, except that the intermediate layer coating composition (Liquid M) was prepared using 16.6 parts of 35% adipic acid dihydrazide dispersion instead of 17.1 parts of 35% adipic acid dihydrazide dispersion, and 9.8 parts of oxazoline group-containing compound instead of 8.0 parts of oxazoline group-containing compound.

EXAMPLE 6

The same heat-sensitive recording material as in Example 1 was obtained, except that the intermediate layer coating composition (Liquid M) was prepared using 19.6 parts of 35% adipic acid dihydrazide dispersion instead of 17.1 parts of 35% adipic acid dihydrazide dispersion, and 4.8 parts of oxazoline group-containing compound instead of 8.0 parts of oxazoline group-containing compound.

EXAMPLE 7

The same heat-sensitive recording material as in Example 1 was obtained, except that the intermediate layer coating composition (Liquid M) was prepared using 21.6 parts of 35% adipic acid dihydrazide dispersion instead of 17.1 parts of 35% adipic acid dihydrazide dispersion, and 1.6 parts of oxazoline group-containing compound instead of 8.0 parts of oxazoline group-containing compound.

EXAMPLE 8

The same heat-sensitive recording material as in Example 1 was obtained, except that the intermediate layer coating composition (Liquid M) was prepared using 125 parts, instead of 200 parts, of the resin latex in which styrene monomers and butadiene monomers are polymerized in an aqueous medium containing a polyurethane ionomer; and 510 parts, instead of 200 parts, of the 10% aqueous solution of partially saponified polyvinyl alcohol; and water was not added.

EXAMPLE 9

The same heat-sensitive recording material as in Example 1 was obtained, except that the intermediate layer coating composition (Liquid M) was prepared using 85 parts, instead of 200 parts, of the resin latex in which styrene monomers and butadiene monomers are polymerized in an aqueous medium containing a polyurethane ionomer; and 650 parts, instead of 200 parts, of the 10% aqueous solution of partially saponified polyvinyl alcohol; and water was not added.

EXAMPLE 10

The same heat-sensitive recording material as in Example 1 was obtained, except that the intermediate layer coating composition (Liquid M) was prepared using 250 parts, instead of 200 parts, of the resin latex in which styrene monomers and butadiene monomers are polymerized in an aqueous medium containing a polyurethane ionomer, and 300 parts, instead of 139.5 parts, of water; and the partially saponified polyvinyl alcohol was not added.

EXAMPLE 11

Preparation of Liquid C (Composite Particle Dispersion)

Fifteen parts of 3-di(n-butyl)amino-6-methyl-7-anilinofluoran, and 3 parts of 3,3-bis(4-diethylamino-2-ethoxyphenyl)-4-azaphthalide as leuco dyes, and 5 parts of 2-hydroxy-4-octyloxybenzophenone were dissolved (150° C.) in a mixed solvent composed of 10 parts of dicyclohexylmethane-4,4'-diisocyanate (Desmodur (registered trademark) W, product of Sumitomo Bayer Urethane Co., Ltd.) and 10 parts of m-tetramethylxylylenediisocyanate (TMXDI (registered trademark), product of Nihon Cytec Industries Inc.) while heating (150° C.) The resulting solution was gradually added to 100 parts of an aqueous solution containing 9 parts of polyvinyl alcohol (PVA-217EE, product of Kuraray Co., Ltd.) and 2 part of the ethylene oxide adduct of an acetylene glycol (Olfine (registered trademark) E1010, product of Nissin Chemical Industry Co., Ltd.) as a surfactant. The mixture obtained was then emulsified and dispersed by agitation using a homogenizer at a speed of 10000 rpm. To the emulsified dispersion were added 30 parts of water, and an aqueous solution in which 1.5 parts of a polyethyleneimine (EPOMIN (registered trademark) SP006, product of Nippon Shokubai Co., Ltd.) was dissolved in 22.5 parts of water. The resulting emulsified dispersion was homogenized, and then heated to 75° C. to carry out a polymerization reaction for 6 hours to prepare a dispersion of leuco dye-containing composite particles having an average particle diameter of 0.8 μm. The resulting dispersion was diluted with water to obtain a 25% leuco dye-containing composite particle dispersion. The resulting dispersion was called Liquid C.

Preparation of Liquid D (Composite Particle Dispersion)

Ten parts of 3-di(n-butyl)amino-6-methyl-7-anilinofluoran, 2.5 parts of 3,3-bis(4-diethylamino-2-ethoxyphenyl)-4-azaphthalide, and 3 parts of 2-hydroxy-4-octyloxybenzophenone were dissolved in a mixed solvent composed of 15 parts of an isocyanurate of hexamethylene diisocyanate (D17OHN, product of Mitsui Takeda Chemicals) and 5 parts of m-tetramethylxylylenediisocyanate (TMXDI (registered trademark), product of Nihon Cytec Industries Inc.) while heating (150° C.). The resulting solution was gradually added to 100 parts of an aqueous solution containing 9 parts of polyvinyl alcohol (PVA-217EE, product of Kuraray Co., Ltd.) and 2 parts of the ethylene oxide adduct of an acetylene glycol (Olfine (registered trademark) E1010, product of Nissin Chemical Industry Co., Ltd.) as a surfactant. The mixture obtained was then emulsified and dispersed by agitation using a homogenizer at a speed of 10000 rpm. To the emulsified dispersion were added 30 parts of water and an aqueous solution in which 1.5 parts of a polyethyleneimine (EPOMIN (registered trademark) SP006, product of Nippon Shokubai Co., Ltd.) was dissolved in 22.5 parts of water. The resulting emulsified dispersion was homogenized, and then heated to 75° C. to carry out a polymerization reaction for 6 hours to prepare a dispersion of leuco dye-containing composite particles having an average particle diameter of 0.8 μm. The resulting dispersion was diluted with water to obtain a 25% leuco dye-containing composite particle dispersion. The resulting dispersion was called Liquid D.

Preparation of First Heat-Sensitive Recording Layer Coating Composition

The first heat-sensitive recording layer coating composition was prepared by mixing a composition composed of 100 parts of Liquid C, 140 parts of Liquid B, 25 parts of a latex (PATELACOLE (registered trademark) H2020A, solids content: 41%, product of Dainippon Ink & Chemicals, Inc.) in which styrene monomers and butadiene monomers are polymerized in an aqueous medium containing a polyurethane ionomer, 0.8 parts of a 10% aqueous solution of perfluoroalkylethylene oxide adduct (Surflon (registered trademark) S-145, product of Seimi Chemical, Co., Ltd.) and 100 parts of water. The resulting dispersion was called Liquid K.

Preparation of Second Heat-Sensitive Recording Layer Coating Composition

The second heat-sensitive recording layer coating composition was prepared by mixing a composition composed of 100 parts of Liquid D, 140 parts of Liquid B, 65 parts of a latex (PATELACOLE (registered trademark) H2020A, solids content: 41%, product of Dainippon Ink & Chemicals, Inc.) in which styrene monomers and butadiene monomers are polymerized in an aqueous medium containing a polyurethane ionomer, 0.8 parts of a 10% aqueous solution of perfluoroalkylethylene oxide adduct (Surflon (registered trademark) S-145, product of Seimi Chemical Co., Ltd.) and 100 parts of water. The resulting dispersion was called Liquid L.

Preparation of Anchor Layer Coating Composition

An anchor layer coating composition was prepared by mixing a composition composed of 220 parts of a latex (PATELACOLE (registered trademark) H2020A, solids content: 41%, product of Dainippon Ink & Chemicals, Inc.) in which styrene monomers and butadiene monomers are polymerized in an aqueous medium containing a polyurethane ionomer, 100 parts of a 10% aqueous solution of partially saponified polyvinyl alcohol (PVA-235, product of Kuraray Co., Ltd.) having a polymerization degree of 3500, 0.5 parts of 10% di(2-ethylhexyl)sodium sulfosuccinate, and 110 parts of water.

Preparation of Intermediate Layer Coating Composition

An intermediate layer coating composition was prepared by mixing a composition comprising 200 parts of a resin latex (PATELACOLE (registered trademark) H2020A, solids content: 41%, product of Dainippon Ink & Chemicals, Inc.) in which styrene monomers and butadiene monomers are polymerized in an aqueous medium containing a polyurethane ionomer, 200 parts of a 10% aqueous solution of partially saponified polyvinyl alcohol (PVA-217EE, product of Kuraray Co., Ltd.), 20.6 parts of 35% dispersion of adipic acid dihydrazide (ADH-35, product of Otsuka Chemical Co., Ltd.), 3.2 parts of an oxazoline group-containing compound (Epocros (registered trademark) WS700, solids content: 25%, product of Nippon Shokubai Co., Ltd.), 4.6 parts of 5% aqueous solution of fluorine-containing surfactant (Megafac (registered trademark) F-444, product of Dainippon Ink & Chemicals, Inc.), and 139.5 parts of water. The resulting intermediate layer coating composition is hereinafter called Liquid N.

Preparation of Heat-Sensitive Recording Material

The anchor coat layer coating composition and the first heat-sensitive recording layer coating composition (Liquid K) were applied in this order to one surface of a blue transparent polyethylene terephthalate film (Melinex (registered trademark) 912, thickness: 175 μm, haze value: 1%, product of Teijin DuPont Films Japan Limited) serving as a support in an amount of 1.5 g/m$^2$ and 15 g/m$^2$, respectively, on a dry basis using a slide coater by way of slide bead coating. The applications of the two layers were performed at the same time, followed by drying. Then, the second heat-sensitive recording layer coating composition (Liquid L), the intermediate layer coating composition (Liquid N), and the protective layer coating composition (Liquid P) were applied in this order in an amount of 7 g/m$^2$, 3.0 g/m$^2$, and 1.5 g/m$^2$, respectively, on a dry basis using a slide coater by way of slide bead coating. The applications of the three layers were performed at the same time, followed by drying to obtain a heat-sensitive recording material.

COMPARATIVE EXAMPLE 1

The same heat-sensitive recording material as in Example 1 was obtained, except that the intermediate layer coating composition (Liquid M) was prepared using 28.6 parts of 35% adipic acid dihydrazide dispersion instead of 17.1 parts of 35% adipic acid dihydrazide dispersion, and that the oxazoline group-containing compound was not added.

COMPARATIVE EXAMPLE 2

The same heat-sensitive recording material as in Example 1 was obtained, except that the intermediate layer coating composition (Liquid M) was prepared using 40 parts of oxazoline group-containing compound instead of 8.0 parts of oxazoline group-containing compound, and that the 35% adipic acid dihydrazide dispersion was not added.

COMPARATIVE EXAMPLE 3

The same heat-sensitive recording material as in Example 1 was obtained, except that the 35% adipic acid dihydrazide dispersion and the oxazoline group-containing compound were not added during the preparation of the intermediate layer coating composition (Liquid M).

COMPARATIVE EXAMPLE 4

The same heat-sensitive recording material as in Example 1 was obtained, except that the protective layer coating composition (Liquid P) was prepared using 500 parts of 8% aqueous solution of completely saponified polyvinyl alcohol (PVA-117, product of Kuraray Co., Ltd.) instead of 500 parts of 8% aqueous solutions of acetoacetyl-modified polyvinyl alcohol.

The following evaluation tests were conducted with respect to the thus-obtained heat-sensitive recording materials. Table 1 shows the results.

Recording Density

Each heat-sensitive recording material was subjected to printing in gradation mode using a thermal printer UP-DF500 (product of Sony Corporation) in a 23° C., 50% RH environment. Of a total of 16 gradations, the recorded densities for the 9th, 13th and 16th gradations were measured using a densitometer (X-Rite 301, product of X-Rite Corp.).

To be used as a heat-sensitive recording material for diagnosis, the density at the 16th gradation is preferably not less than 3.2.

Haze Value

The haze value of each heat-sensitive recording material was measured using a haze meter (TC-H: product of Tokyo Denshoku). It is preferable that the haze value be 40 or less, which ensures high transparency. A haze value of 30 or less is more preferable.

Quality of Recording Surface

The recording surface of each heat-sensitive recording material was visually observed before subjected to recording, and the surface quality was evaluated with the following evaluation criteria.

A: Excellent, with no roughness

B: Practical use level, with some roughness on the recording surface

C: Unsuitable for practical use due to a great deal of roughness on the recording surface Thermal-Background-Fogging A heat-sensitive recording material was allowed to stand for 20 hours under a dry environment at 60° C., and the b* value (transmittance) of the unrecorded part was measured using a SpectroScan T (product of GretagMacbeth). The b* value of the unrecorded part of another untreated heat-sensitive recording material was measured, thereby calculating the difference Δb* between the two b* values of the treated and untreated heat-sensitive recording materials. A Δb* value of less than 3.0 denotes a practical use level. It is more preferable that Δb* be less than 2.0, further preferably less than 1.0.

$$\Delta b^* = b^* \text{ (treated)} - b^* \text{ (untreated)}$$

Water Resistance

Five cc of water was allowed to fall dropwise onto an unprinted part of a heat-sensitive recording material. After 30 seconds, the water was wiped with a nonwoven cloth, and the resulting portion was visually observed and evaluated with the following evaluation criteria.

A: No changes were observed

B: The portion became white, but no detachment was observed between the protective layer, the intermediate layer, and the heat-sensitive recording layer C: Detachment was observed on the protective layer and the intermediate layer, but no detachment was observed on the heat-sensitive recording layer D: Detachment was observed on the protective layer, the intermediate layer and the heat-sensitive recording layer Heat Resistance Each heat-sensitive recording material was subjected to printing using a UP-DF500 printer (product of Sony Corporation) in a full black mode. After the printing, the recorded surface was visually observed under oblique light, and the surface roughness (print-burning) due to printing was evaluated under the following criteria. Observation under oblique light allows uneven brightness on the recorded surface due to print-burning to become visible, thereby increasing accuracy in evaluation.

A: No print-burning was observed

B: Practical use level with some print-burning on the recorded surface

C: Unsuitable for practical use due to slightly significant print-burning

D: Unsuitable for practical use due to a great deal of print-burning

TABLE 1

| | mass ratio of relating to intermediate layer | | | | | | | | | |
|---|---|---|---|---|---|---|---|---|---|---|
| | hydrazine-based compound to the oxazoline group-containing compound | water-dispersible adhesive to water-soluble adhesive | Recording Density 9th gradation | 13th gradation | 16th gradation | haze value | Quality of recording surface | Thermal-background-fogging Δb* | Water Resistance | Heat Resistance |
| Example 1 | 75:25 | 80:20 | 0.90 | 1.70 | 3.20 | 29 | A | 1.0 | A | A |
| Example 2 | 90:10 | 80:20 | 0.93 | 1.78 | 3.26 | 28 | A | 0.6 | A | A |
| Example 3 | 60:40 | 80:20 | 0.93 | 1.83 | 3.30 | 35 | B | 2.0 | B | A |
| Example 4 | 97:3 | 80:20 | 0.93 | 1.81 | 3.27 | 28 | B | 0.5 | B | B |
| Example 5 | 70:30 | 80:20 | 0.92 | 1.71 | 3.21 | 29 | A | 1.0 | A | A |
| Example 6 | 85:15 | 80:20 | 0.92 | 1.77 | 3.25 | 28 | A | 0.7 | A | A |
| Example 7 | 95:5 | 80:20 | 0.93 | 1.80 | 3.26 | 28 | A | 0.6 | A | A |
| Example 8 | 75:25 | 50:50 | 0.94 | 1.76 | 3.27 | 29 | A | 1.0 | A | A |
| Example 9 | 75:25 | 35:65 | 0.94 | 1.80 | 3.29 | 29 | A | 1.0 | B | A |
| Example 10 | 75:25 | 100:0 | 0.90 | 1.71 | 3.21 | 35 | B | 1.0 | A | A |
| Example 11 | 90:10 | 80:20 | 1.15 | 2.10 | 4.00 | 29 | A | 0.9 | A | A |
| Comparative Example 1 | 100:0 | 80:20 | 0.93 | 1.81 | 3.27 | 28 | B | 0.4 | C | C |
| Comparative Example 2 | 0:100 | 80:20 | 0.94 | 1.85 | 3.32 | 45 | C | 3.0 | D | C |
| Comparative Example 3 | 0:0 | 80:20 | 1.02 | 1.92 | 3.46 | 27 | A | 3.6 | D | D |
| Comparative Example 4 | 75:25 | 80:20 | 0.95 | 1.80 | 3.20 | 28 | A | 0.2 | D | D |

INDUSTRIAL APPLICABILITY

The heat-sensitive recording material of the present invention has excellent transparency, water resistance, heat resistance, and surface quality; and has small thermal-background-fogging. Accordingly, the heat-sensitive recording material of the present invention is useful as transparent heat-sensitive recording materials for medical devices, medical image diagnosis, or medical references, including schaukastens, magnetic resonance image diagnoses, X-ray image diagnoses, or the like.

The invention claimed is:

1. A heat-sensitive recording material comprising one or more heat-sensitive recording layers, an intermediate layer and a protective layer that are formed on one side of a transparent support, wherein:

the one or more heat-sensitive recording layers are formed from one or more heat-sensitive recording layer coating compositions that each contain a leuco dye and a developer, the intermediate layer is formed from an intermediate layer coating composition that contains a hydrazine-based compound and an oxazoline group-containing compound, and the protective layer is formed from a protective layer coating composition that contains a modified polyvinyl alcohol.

2. The heat-sensitive recording material according to claim 1, wherein the mass ratio of the hydrazine-based compound to the oxazoline group-containing compound ranges from 70:30 to 95:5.

3. The heat-sensitive recording material according to claim 1 or 2, wherein the modified polyvinyl alcohol is an acetoacetyl-modified polyvinyl alcohol.

4. The heat-sensitive recording material according to claim 1 or 2, wherein the intermediate layer coating composition contains a water-dispersible adhesive that is a polymer latex having a heterogeneous particle structure that contains a urethane resin component in at least one phase.

5. The heat-sensitive recording material according to claim 4, wherein the intermediate layer coating composition further contains a water-soluble adhesive, and the mass ratio of the water-dispersible adhesive to the water-soluble adhesive ranges from 90:10 to 50:50.

6. The heat-sensitive recording material according to claim 1 or 2, wherein the leuco dye has a form of composite particles containing a leuco dye and a hydrophobic resin.

7. The heat-sensitive recording material according to claim 1 or 2, wherein the one or more heat-sensitive recording layers, the intermediate layer and the protective layer are formed by simultaneously applying and drying the one or more heat-sensitive recording layer coating compositions, the intermediate layer coating composition, and the protective layer coating composition.

8. The heat-sensitive recording material according to claim 1 or 2, wherein the one or more heat-sensitive recording layers each contain a leuco dye and a developer, the intermediate layer contains a hydrazine-based compound and an oxazoline group-containing compound, and the protective layer contains a modified polyvinyl alcohol.

9. The heat-sensitive recording material according to claim 1 or 2, wherein the transparent support is a polyethylene terephthalate film.

10. A process for producing a heat-sensitive recording material comprising one or more heat-sensitive recording layers, an intermediate layer and a protective layer that are formed on one side of a transparent support, the process comprising the steps of:

(1) forming one or more heat-sensitive recording layers using one or more heat-sensitive recording layer coating compositions each containing a leuco dye and a developer;

(2) forming an intermediate layer using an intermediate layer coating composition containing a hydrazine-based compound and an oxazoline group-containing compound; and (3) forming a protective layer using a protective layer coating composition containing a modified polyvinyl alcohol.

11. The process according to claim 10, wherein, in the steps (1), (2) and (3), the one or more heat-sensitive recording layers, the intermediate layer and the protective layer are formed by simultaneously applying and drying the one or more heat-sensitive recording layer coating compositions, the intermediate layer coating composition and the protective layer coating composition.

* * * * *